169-46 SR
12/23/86 OR 4,630,684

United States Patent [19]
Cinzori et al.

[11] Patent Number: 4,630,684
[45] Date of Patent: Dec. 23, 1986

[54] FIRE SENSING AND SUPPRESSION METHOD AND SYSTEM RESPONSIVE TO OPTICAL RADIATION AND MECHANICAL WAVE ENERGY

[75] Inventors: Robert J. Cinzori, Santa Barbara; Mark T. Kern, Goleta, both of Calif.

[73] Assignee: Santa Barbara Research Center, Goleta, Calif.

[21] Appl. No.: 621,645

[22] Filed: Jun. 18, 1984

[51] Int. Cl.[4] ..... A62C 37/04
[52] U.S. Cl. ..... 169/46; 169/61; 169/62; 250/339; 340/522; 340/578
[58] Field of Search ..... 169/43, 45, 46, 56, 169/60, 61, 19, 62; 340/521, 522, 577–579; 250/339, 352

[56] References Cited

U.S. PATENT DOCUMENTS 3,405,271 10/1968 Stevens et al. ..... 250/352
3,405,272 10/1968 Stevens et al. ..... 250/352
3,405,273 10/1968 Stevens et al. ..... 250/352
3,634,846 1/1972 Fogiel ..... 340/579
3,825,754 7/1974 Cinzori et al. ..... 250/339
3,831,318 8/1974 Richmond et al. ..... 340/522
3,931,521 1/1976 Cinzori ..... 250/339
4,005,754 2/1977 Linden et al. ..... 169/46
4,296,324 10/1981 Kern et al. ..... 250/339

FOREIGN PATENT DOCUMENTS 2395554 2/1979 France ..... 340/522

*Primary Examiner*—Jeffrey V. Nase
*Attorney, Agent, or Firm*—R. L. Taylor; A. W. Karambelas

[57] ABSTRACT

Described herein is a method and system for sensing explosive fires by the parallel processing of signals derived from both electromagnetic radiation and mechanical wave energy simultaneously emanating from or near the source of these fires. This diverse-stimuli sensing capability enhances the false alarm immunity of the system.

20 Claims, 10 Drawing Figures

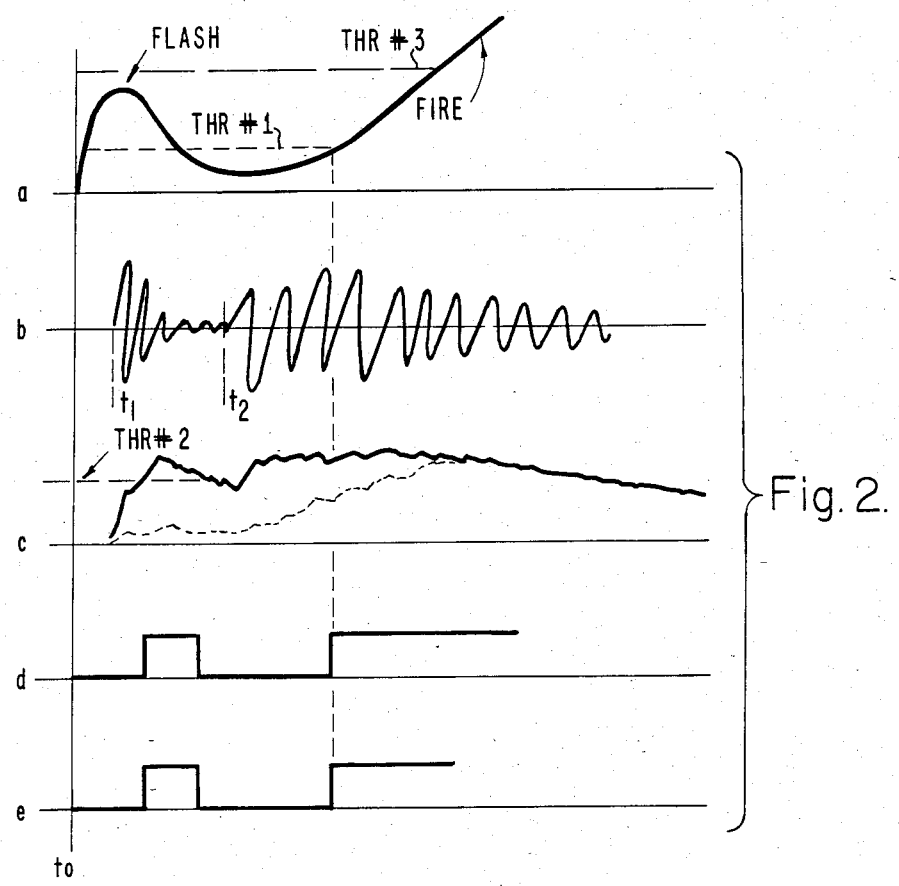
Fig. 2.
Fig. 4.
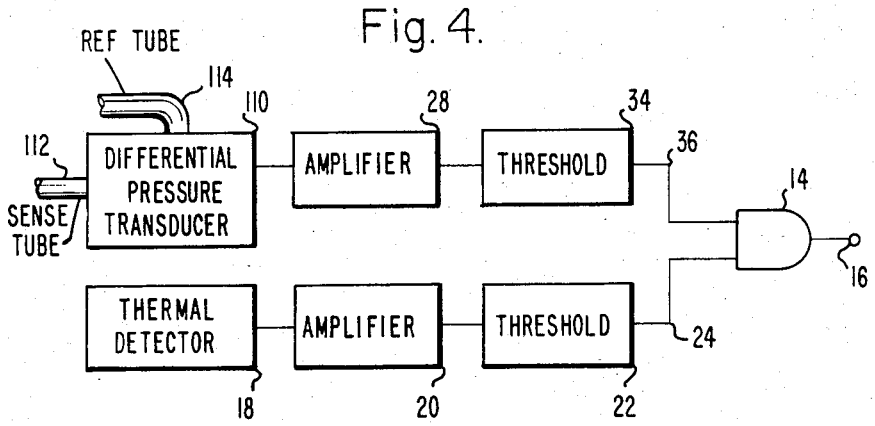

FIRE SENSING AND SUPPRESSION METHOD AND SYSTEM RESPONSIVE TO OPTICAL RADIATION AND MECHANICAL WAVE ENERGY

BACKGROUND OF THE INVENTION

1. Field of the Invention

This invention relates generally to fire and explosion sensing and suppression systems and methods, and more particularly to such systems which respond to diverse fire and explosion-producing stimuli to generate a fire suppression output signal. Thus, the false alarm immunity of the system is enhanced.

2. Description of the Prior Art

Multichannel optical (e.g. infrared radiation responsive) systems are known in the art of fire suppression, and typical of such systems are those disclosed and claimed in U.S. Pat. Nos. 3,825,754, 3,931,521 and 4,296,324 assigned to the present assignee. These patented inventions made by Robert J. Cinzori et al have proven highly acceptable, commercially successful and useful in a variety of military fire sensing and suppression system (FSS) applications.

Certain modifications and applications of these fire sensing and suppression systems are described by Robert J. Cinzori in a publication entitled "Dual Spectrum Infrared Fire Sensor," *25th National Infrared Information Symposium (IRIS)* June 15, 1977. All of these citations are fully incorporated herein by reference.

SUMMARY OF THE INVENTION

In contrast to the above-identified FSS systems which operate solely in response to optical stimuli, i.e. electromagnetic radiation, the present invention responds to the simultaneous occurrence of diverse stimuli, such as a combination of optical radiation and mechanical wave energy, e.g. pressure or acoustic wave energy, to impart an enhanced false alarm immunity to a variety of commercial as well as military fire suppression systems. Accordingly, the general purpose of this invention is to provide a broad new method for suppressing fires and explosions and a corresponding broad new class of fire suppression systems having a high degree of false alarm immunity.

To accomplish this purpose, we have developed a novel system and method for suppressing fires and explosions which includes the steps of sensing the occurrence of electromagnetic wave energy in an optical signal processing channel and simultaneously sensing mechanical wave energy in a diverse stimuli signal processing channel to in turn simultaneously generate first and second detection signals. These detection signals are then processed simultaneously in parallel and at high speeds, i.e. milliseconds, to generate a fire suppression output signal which is used to activate a fire suppressant, such as halon gas or the like.

Thus, the present invention provides certain further new and useful improvements in the art of fire sensing and suppression in that it requires an additional stimulus associated with the fire or explosion before generating an output signal. For example, a bright light bulb (producing UV, visible and near IR stimuli) in front of an exhaust manifold (producing a heat stimulus in the far IR region of the electromagnetic wavelength spectrum) could produce a false alarm in the above prior art systems when exposed to amplitude variations of radiation input from these sources. The added requirement of a diverse stimuli input by the present invention will prevent false alarms under the above described condition.

The above purpose and other useful and novel features of this invention will become more readily apparent in the following description of the accompanying drawings.

BRIEF DESCRIPTION OF THE DRAWINGS

FIGS. 2–2*e* are waveform diagrams of electrical signals at the various circuit nodes A through E identified in FIG. 1*b*.

FIG. 4 is a functional block diagram of another dual-channel (differential pressure and optical radiation) fire sensing and suppression system according to another embodiment of the invention.

DETAILED DESCRIPTION OF THE INVENTION

Figure 1A:
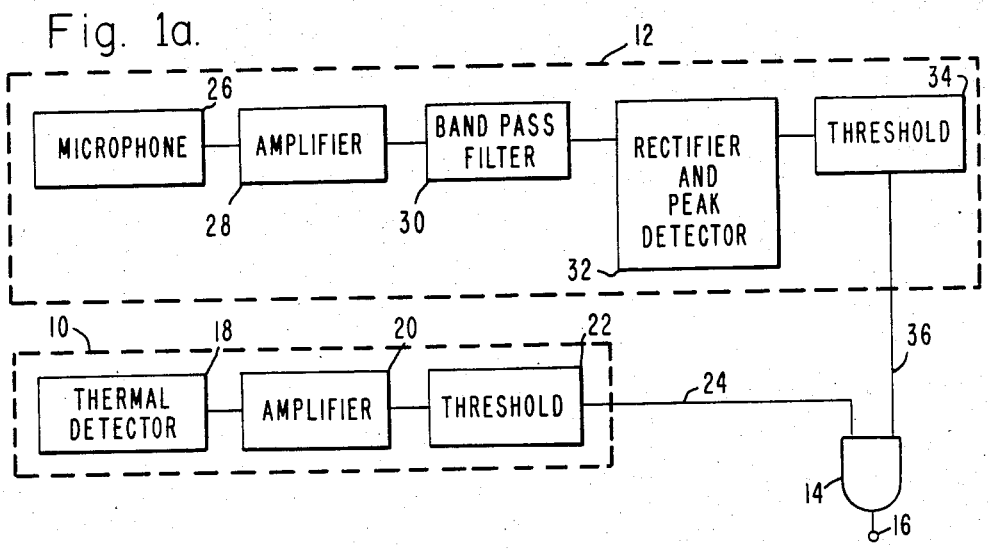
FIG. 1*a* is a functional block diagram of the dual-channel (electromagnetic and mechanical wave energy) fire sensing and suppression (FSS) system according to one embodiment of the present invention. This embodiment is designed to respond to a situation where a very loud noise, such as that produced by a shell piercing metal, accompanies a thermal event, such as an explosive fire.

Referring now to FIG. 1*a*, there is shown a dualchannel fire sensing and suppression system including an electromagnetic wave energy channel 10 and a mechanical wave energy channel 12 connected as shown to an output AND gate 14 which provides a fire suppression output signal at the output node 16. The optical channel 10 includes a thermal detector 18 having its output connected to a non-inverting amplifier stage 20 which in turn is connected to a threshold gate or stage 22. The output signal from the threshold stage 22 is connected as shown to one input connection 24 of the output AND gate 14.

The mechanical wave energy channel 12 includes an input transducer in the form of a dynamic microphone 26 having its output connected to an inverting amplifier 28. This microphone is used to pick up a loud noise, such as that produced by a round of ammunition piercing a metal wall of a protected enclosure such as an airplane or ground vehicle. This noise will be extremely loud and, in turn, will produce an amplified signal in channel 12 sufficient to override the threshold voltage on threshold gate 34 and produce an output signal on line 36 in a manner to be further described.

The output signal from the inverting amplifier 28 is connected as shown to a bandpass filter stage 30 which in turn has its output connected to a rectifier and peak detector stage 32. The amplitude modulated rectified output signal (envelope) from the peak detector stage 32 is connected as shown to a threshold gate 34 which in turn is connected to the other input connection 36 for the output AND gate 14.

When the input radiation sensors 18 and 26 of the system according to FIG. 1*a* are exposed to an explosion or fire above a predetermined magnitude which is accompanied by a loud noise as described above, the radiation-produced electrical signals in both the optical and mechanical wave energy channels 10 and 12 are of a magnitude sufficient to provide digital driving signals on lines 24 and 36 to in turn generate an output fire suppression signal at the output terminal 16 of the AND gate 14. This output signal is in turn used to energize a high speed valve (not shown) operative to release of a suitable fire and explosion suppressant, such as halon gas. For a further general discussion of these high speed valves and fire suppressant containers and their connections to all of the electrical systems disclosed herein, reference should be made to the above-identified IRIS publication by R. J. Cinzori of June 15, 1977.

Figure 1B:
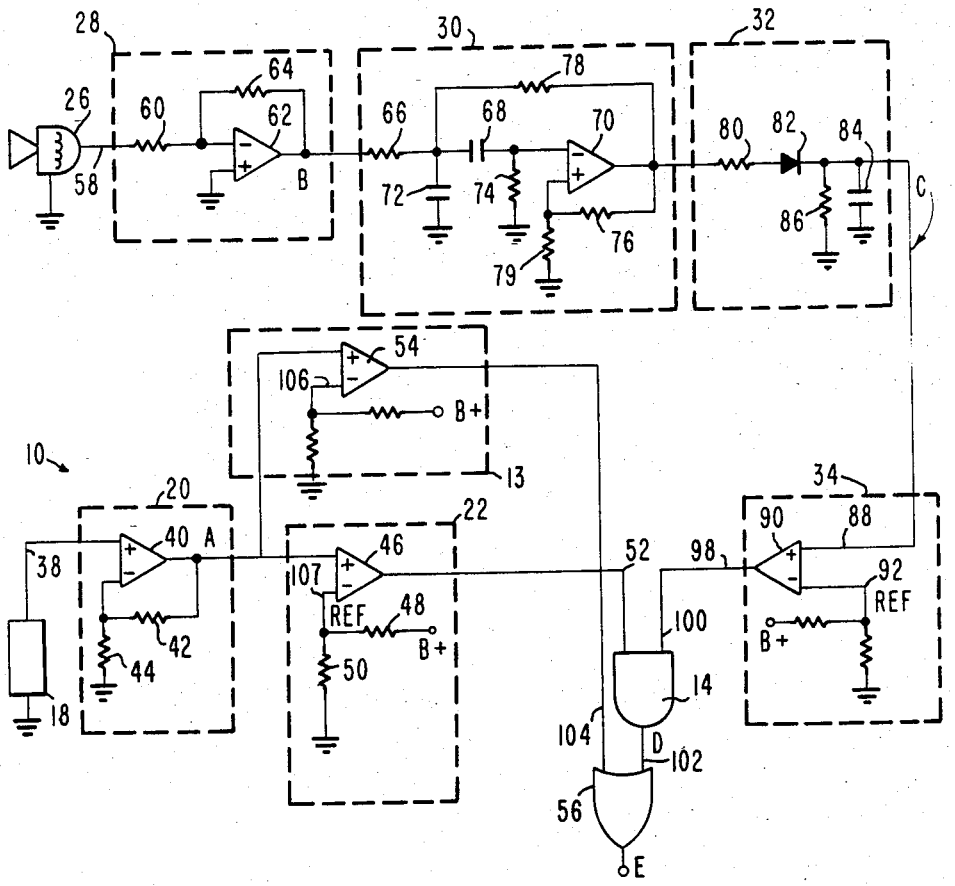
FIG. 1*b* is a schematic circuit diagram of a preferred embodiment of FIG. 1*a* constructed in accordance with the presently known best mode for practicing this embodiment of the invention.

The specific operation and various features of the fire sensing and suppression system shown in FIG. 1*a* will become better understood by referring to the corresponding schematic circuit diagram of FIG. 1*b* wherein the same reference numerals are used to indicate the corresponding circuit stages therein. The thermal detector 18 in the optical signal processing channel 10 may, for example, be a thermopile detector. Such a detector is fabricated by the Santa Barbara Research Center (SBRC) of Goleta, California and incorporates various types of coated filters as the optical front surface of the detector's TO-5 package. This detector is described in U.S. Pat. Nos. 3,405,271, 3,405,272 and 3,405,273. The electrical signal developed at the output conductor 38 from the detector 18 is connected as shown to one input of the non-inverting operational amplifier 40 of the amplifier stage 20. The resistor 42 and the resistor 44 are selected, as is known in the art, with values which establish the gain of the amplifier stage 20.

The amplified signal at the output node A of the operational amplifier 40 is connected directly to the positive input of a DC comparator 46 in the threshold stage 22 previously described. Alternatively, a capacitor can be inserted between node A and the positive input of comparator 46 to eliminate DC offsets that may occur if the gain of amplifier 20 is very high. The resistors 48 and 50 in the threshold stage 22 establish the DC reference voltage level at the other input terminal 107 of the comparator 46, and the output signal of the comparator 46 is connected via conductor 52 to one input of the output AND gate 14.

In addition to the thermal detector 18, the amplifier stage 20 and threshold stage 22, the schematic circuit diagram in FIG. 1*b* includes a thermal override parallel channel 13 including a DC comparator 54 and an output OR gate 56. This thermal override channel 13 is described and claimed in copending Application Ser. No. 419,872 entitled "Discriminating Fire Sensor with Thermal Override Capability," filed Sept. 20, 1982 by the present assignee and incorporated herein by reference. The operation of channel 13 will be described in more detail in this specification, and this channel responds to high levels of thermal radiation which are characteristic of full scale fires and explosions to provide an added measure of fire protection for the system.

The mechanical wave energy channel 12 includes an input dynamic microphone 26 responsive typically to frequencies of 1–5 kHz for generating a second detection signal which is present on conductor 58. The output conductor 58 from the microphone 26 is connected through an input resistor 60 to one input terminal of the inverting operational amplifier 62 of the amplifier stage 28. The values of the feedback resistor 64 and the input resistor 60 are selected to set the gain of the amplifier stage 28, and the amplified signal at node B of stage 28 is connected as shown through a series resistor 66 and a filter capacitor 68 to one input of an operational amplifier 70 within the bandpass filter stage 30. These components 66, 68 and 70, together with the shunt capacitor 72 resistor 74, and resistors 76, 78, and 79 are selected in value to provide the desired frequency passband for signals coupled from node B to the series charge resistor 80 in the following rectifier and peak detector stage 32. The passband of stage 30 will, of course, be set to correspond to the frequencies expected from the dynamic microphone 26 (for example 1 to 5 kHz).

The construction, connection and component value selection for the desired frequency passband of the bandpass filter stage 30 are readily available to those skilled in the art and may be selected, for example, with reference to Hilburn and Johnson, *Manual of Active Filter Design*, McGraw-Hill, 1973. Other similar references which may be useful in this regard include: Zverev, *Handbook of Filter Synthesis*, Wiley, 1967; Markus, *Electronic Circuits Manual*, McGraw-Hill, 1971; Markus, Guidebook of Electronic Circuits, McGraw-Hill, 1974; and Markus, *Modern Electronic Circuits Reference Manual*, McGraw-Hill, 1980. All of these reference materials are incorporated herein by reference.

The rectifier and peak detector stage 32 further includes a diode rectifier 82 having its output connected to a capacitor 84 at node C and a discharge resistor 86 connected in parallel with the capacitor 84. The series resistance 80 establishes the charge rate of the capacitor 84 whereas the parallel connected resistor 86 establishes the discharged rate of capacitor 84. As is well known, the value of these latter components 80, 84 and 86 are selected to provide the desired voltage envelope at node C, and this voltage is connected as shown to one input 88 of the DC voltage comparator 90 within the threshold stage 34. The other input 92 of the comparator 90 is connected to resistors 94 and 96 which determine the reference voltage on the input conductor 92 of the comparator 90. This reference voltage corresponds to the sound level to be detected (or discriminated) so that when the loud noise (e.g., ammunition piercing metal) produces a certain decibel level in FIG. 2*b*, the detected voltage level from stage 32 and appearing on conductor 88 will override the reference voltage on conductor 92 and produce an output signal on conductor 98.

The output conductor 98 from the threshold stage 34 is connected as shown to a second input conductor 100 of the AND gate 14, and the output conductor 102 of the AND gate 14 is connected as one input to an output OR gate 56. The other input conductor 104 of the OR gate 56 is connected as previously indicated to the output conductor of the comparator stage 54 within the heat override channel 13. The operation and signal processing in the circuit of FIG. 1*b* will be better understood by reference to the waveform diagrams in FIGS. 2*a*–2*e*. These diagrams correspond, respectively, to the voltages at nodes A, B, C, D and E in FIG. 1*b*.

The waveform in FIG. 2*a* is a voltage signal produced by the radiation signature received at the thermal detector 50 and then amplified by the amplifier stage 20. This voltage signature rises rapidly across a first threshold level, THR #1, and then descends sharply back through this level before again reversing slope to indicate a developing fire. Once above the threshold level THR #1, the voltage at node A exceeds the reference voltage on the DC comparator 46. This voltage change produces a digital input signal on conductor 52 at one input of the output AND gate 14 as long as the voltage signal in FIG. 1*a* is above the threshold level THR #1.

The loud acoustic burst signal B in FIG. 2*b* is delayed as shown between time $t_0$ and time $t_1$ (and a reflected signal is similarly delayed between $t_0$ and $t_2$), which corresponds to the travel time of sound from the source of the explosion to the microphone 26, with the sound waves traveling at approximately at 1100 ft. per second. This acoustic burst in turn produces a voltage signal at the output of the microphone 26 which is coupled through the bandpass amplifier 30 to develop the detected voltage envelope at node C as shown in FIG. 2*c*. When this detection envelope is above the threshold level THR #2 shown in FIG. 2*c*, the voltage signal on the input conductor 88 of the DC comparator 90 exceeds the reference voltage on the other input conductor 92 to thereby generate a second AND gate input signal on conductor 100. This action in turn produces voltage output pulses D and E on the output conductors of AND and OR gates 14 and 56, respectively. Thus, the digital output signal E in FIG. 2*e* serves as a fire suppression system output signal for activating a high-speed valve which in turn releases a fire suppressant, such as halon gas. This action all takes place within about five (5) milliseconds of the occurrence of the radiation-producing event to which the above dual channel system responds.

Should it be desirable for the system to wait for the fire to develop before responding (and if a somewhat longer response time is acceptable), resistor 80 can be increased in order to increase the charge time of the envelope detection circuit including components 80, 82 and 84. The resulting envelope at node C would then be the dotted waveform of FIG. 2*c*.

The thermal override channel 13 includes a DC comparator stage 54 whose reference voltage level on conductor 106 is much greater than the reference voltage settings on the other comparators, typically on the order of ten times greater than the other reference voltage settings in the circuit. This setting is to insure that this heat override channel will, after some delay, respond to large scale fires and explosions which occur even though the mechanical wave energy channel 12 is, for some reason, not activated. This override will occur when the fire signature in FIG. 1*a* crosses the third threshold level THR #3 as indicated to override the DC reference voltage on comparator 54 (stage 13) and thereby generate a fire suppression output signal on conductor 104.

Figure 3:
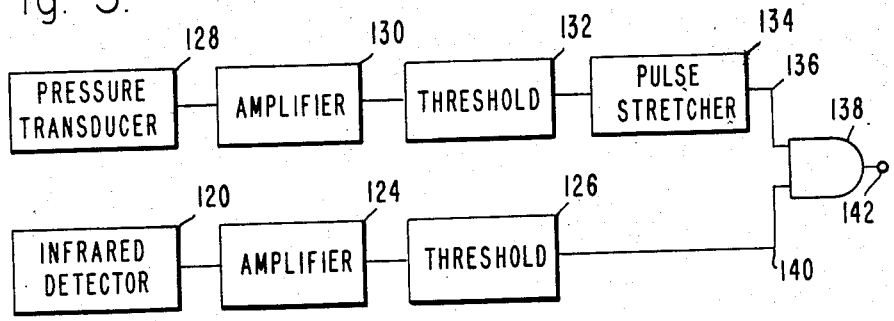
FIG. 3 is a functional block diagram of another dual-channel (absolute pressure and optical radiation) fire sensing and suppression system in accordance with yet another embodiment of the invention. This system of FIG. 3 responds, for example, to infrared radiation which is accompanied by a pressure build up in a fuel tank which is indicative of a full scale fire or explosion. Such pressure build up must exist for a predetermined period of time to discriminate against short-lived pressure changes produced by other non-fire-producing stimulii.

Referring now to FIG. 3, there is shown a dual-channel, combination optical responsive-pressure responsive fire sensing and suppression system according to the invention. In this embodiment, the optical channel includes an infrared detector 120 connected to drive an amplifier stage 124 which in turn is connected to a threshold gate 126. These stages 120, 124 and 126 may be implemented, circuit wise, in a fashion similar to the circuit implementation of stages 18, 20 and 22 in FIG. 1*a* and FIG. 1*b* previously described.

The second or pressure responsive channel of FIG. 3 includes an absolute pressure transducer 128, an amplifier stage 130 for amplifying the output signal of the transducer 128 and a threshold gate 132 connected in series to drive a 10 millisecond pulse stretcher (time delay) stage 134. The pressure transducer 128 may, for example, be a strain gauge type of transducer and operative to generate an output voltage which is linearly dependent upon input pressure. Alternatively, the transducer 128 may be a semiconductor type pressure transducer, and the latter type of transducer is available from Sensym, Inc, of Sunnyvale, CA. Such transducer will typically include a pressure responsive diaphram built into a semiconductor package.

The output of the pulse stretcher stage 134 is connected as shown to one input conductor 136 of an output AND gate 138. In this embodiment, the pressure transducer 128 is operative to respond, for example, to a pressure buildup within a protected area, such as a bay or fuel tank, which accompanies a fire or explosion therein and thereby provide an enhanced false alarm immunity to the system. If, however, a projectile should pass through a portion of the fuel tank without producing a fire and explosion, or if an ammunition round should explode outside the fuel tank without producing a fire and explosion, the pressure change resulting from these events will not be of sufficient amplitude to produce an output pulse on line 136. The signal on line 136 will always be 10 milliseconds longer than the pressure pulse seen by transducer 128. This pulse stretcher stage 134 thus aids the coincidence of pressure and optical events to prevent phase shifts from inhibiting proper recognition of the fire or explosion.

Thus, the output AND gate 138 responds to the simultaneous occurrence of digital signals on conductors 136 and 140 to provide a fire suppression output signal at the output node 142 upon any type of pressure buildup (of sufficient amplitude) in the fuel tank which accompanies the rise of a full scale fuel fire therein.

In an alternative embodiment and modification of the schematic of FIG. 3, the pulse stretcher 134 can be replaced with an integrator or delay stage (not shown) so that the pressure signal exceeding threshold 132 would need to be present at the input of the proposed new delay for at least 10 milliseconds before an output is generated at line 136. This arrangement may be more useful for cases where higher sensitivity is required and will eliminate the possibility of short-lived pressure changes at the transducer producing an extraneous false alarm output fire suppression signal on line 142. Specifically, this alternative embodiment allows one to discriminate against (or distinguish between) the "flash" and "fire" in some cases. If the pressure waveform is similar in shape to the infrared signal of FIG. 2*a*, and the pressure from the "flash" had decayed below the threshold set by threshold stage 132 in less than 10 milliseconds, then the circuit of FIG. 3 will wait for the pressure rise from the hydrocarbon explosion (the "fire" of FIG. 2*a*) before producing an output signal on line 142.

Referring now to FIG. 4, there is shown another embodiment of the invention wherein a differential pressure transducer stage 110 has been used instead of the absolute pressure transducer of FIG. 3. The differential pressure transducer 110 is connected to an input sense tube 112 and to an input reference tube 114 which are together utilized to sense differential pressure changes at the location of stage 110. This embodiment of the invention is most useful where one needs to sense pressure changes that are equal to or smaller than standard atmospheric pressure. For example, for aircraft flying at 70,000 ft. or higher, atmospheric pressure is considerably less than at sea level. If the reference tube "references" the pressure existing under ambient conditions, a compensating effect occurs such that small changes can be sensed by transducer 110. The reference tube 114 might, for example, be connected to either the aircraft cockpit or to the outside ambient, whereas the sense tube 112 might be connected near the bleed air lines or ducts in the aircraft dry bay which conduct the hot air from the engine compressor to other parts of the aircraft. Should this bleed line be punctured by either a round of ammunition or by flying shrapnel from a nearby strike or by some other malfunction at these lines capable of producing a fire, explosion, or overheat condition, the transducer 110 will immediately sense the differential pressure change caused by the air flowing from this puncture to generate a corresponding output voltage on line 116.

The thermal detector 18 also views the inside of the enclosed area, e.g., the aircraft dry bay, to concurrently detect the onset of thermal radiation with an increase in pressure therein, and the amplifier stages 20 and 28 and the threshold stages 22 and 34 correspond to the identically numbered stages in FIG. 1*a* previously described. The same is true for the output AND gate 14 and its associated connections.

Figure 5:
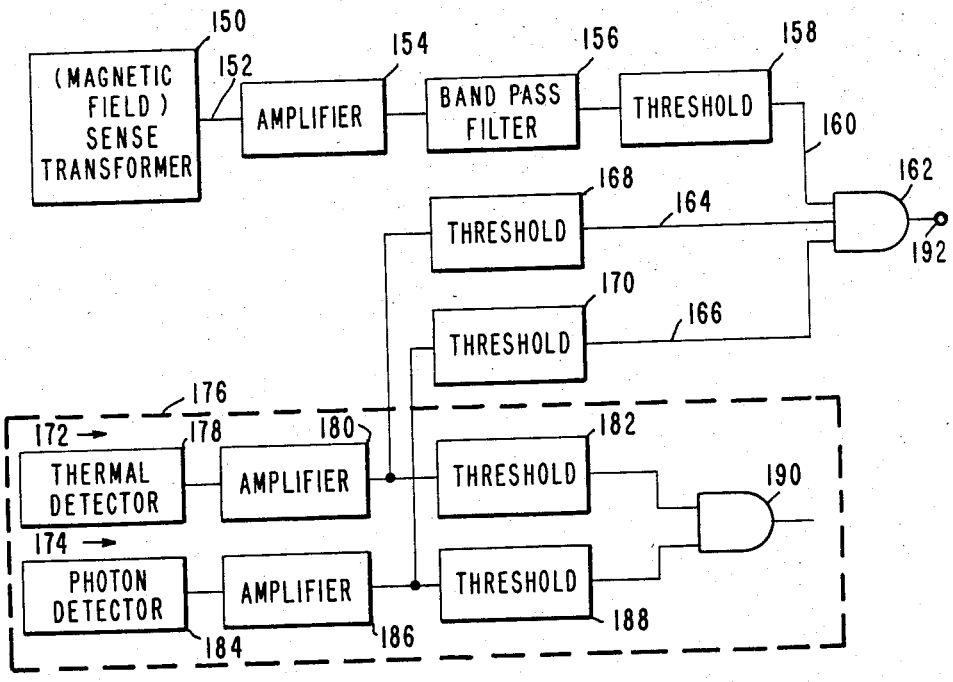
FIG. 5 is a functional block diagram of a further embodiment of the invention including a three-channel (thermal/photon/magnetic field) fire sensing and suppression system.
Figure 7:
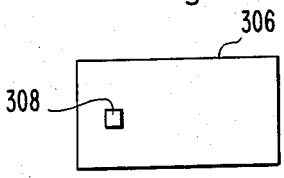
FIG. 7 is a schematic diagram showing a sensor mounted on a housing of a fuel tank of a military vehicle.

Referring now to FIG. 5, there is shown the combination optical/magnetic-field-responsive fire sensing and suppression system according to the present invention. In this system, a magnetic field sense transformer 150 functions to generate an output signal when its surrounding magnetic field has been sufficiently interrupted by an event which, in all probability, will accompany the onset of a fire or explosion. The transformer 150 will include a coil of wire which is connected to measure a known magnetic field in the area to be monitored for a fire or explosion. This area may include the housing 306 (FIG. 7) of a fuel tank of a combat vehicle. If a shell were to pierce this housing, this event will produce a corresponding change in the reluctance of the flux path including the coil 308 of wire and this event, in turn, will produce an output signal on conductor 152.

Figure 9:
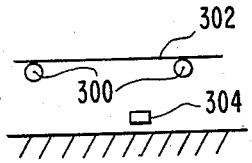
FIG. 9 is a schematic diagram showing a sensor mounted to detect diversion of a moving metal part from a desired path of travel.

Alternatively, however, the system of FIG. 5 may be useful in non-combat industrial applications such as, for example, a rolling mill where certain areas go unattended for long periods of time. Should a carrier 300 (FIG. 9) transporting sheet metal 302 or the like malfunction and cause the metal to be mishandled or dropped, etc., this event would produce a change in the flux path reluctance and generate an output signal on the sense transformer coil 304 in stage 150. However, the magnitude of this signal is related to the size of the mishandled metal (or size of the shell in the combat situation) and the distance between the mechanical event (e.g., shell interrupting the flux path) and the sense coil, as will be appreciated by those skilled in the art. Thus, these parameters and the size and strength of the coil's magnetic field must be taken into consideration when setting threshold levels in the electronic circuits used to implement the system of FIG. 5.

The output signal generated on conductor 152 is amplified in the following amplifier stage 154 and then coupled through a bandpass filter stage 156 similar to the bandpass filter network 30 in FIG. 1*b* above. The signal passed through the bandpass filter 156 is then passed through a threshold gate 158 similar to the threshold gate 134 in FIG. 1*b* above. The output from the threshold gate 158 is connected as shown to one input conductor 160 to an output AND gate 162.

The other two input conductors 164 and 166 for the output AND gate 162 are connected via threshold stages 168 and 170, respectively, to the thermal and photon detector channels 172 and 174, respectively, of a dual-channel fire sensing and suppression (FSS) system of a type known and available in the art. This FSS system is designated generally as 176 and may for example be the type described in U.S. Pat. No. 3,931,521 assigned to the present assignee. In this patented system, the long wavelength or thermal heat channel 172 includes a thermal detector 178, an amplifier 180 and a threshold gate 182, whereas the photon or short wavelength (light) channel 174 includes a photon detector 184, an amplifier stage 186 and a threshold gate 188 connected as shown to drive an output AND gate 190.

Thus, when a mechanical event likely to produce an explosive fire also produces an interruption in the magnetic field of the coil of the magnetic field sense transformer 150, the output signal generated on conductor 152 in the magnetic field sense channel is processed in combination with signals in the thermal and photon detector channels 170 and 174. These multiple signals are thus utilized to generate the three necessary AND gate input signals on conductors 160, 164 and 166 and in turn provide a fire suppression output signal at the output node 192 of the AND gate 162.

Figure 6:
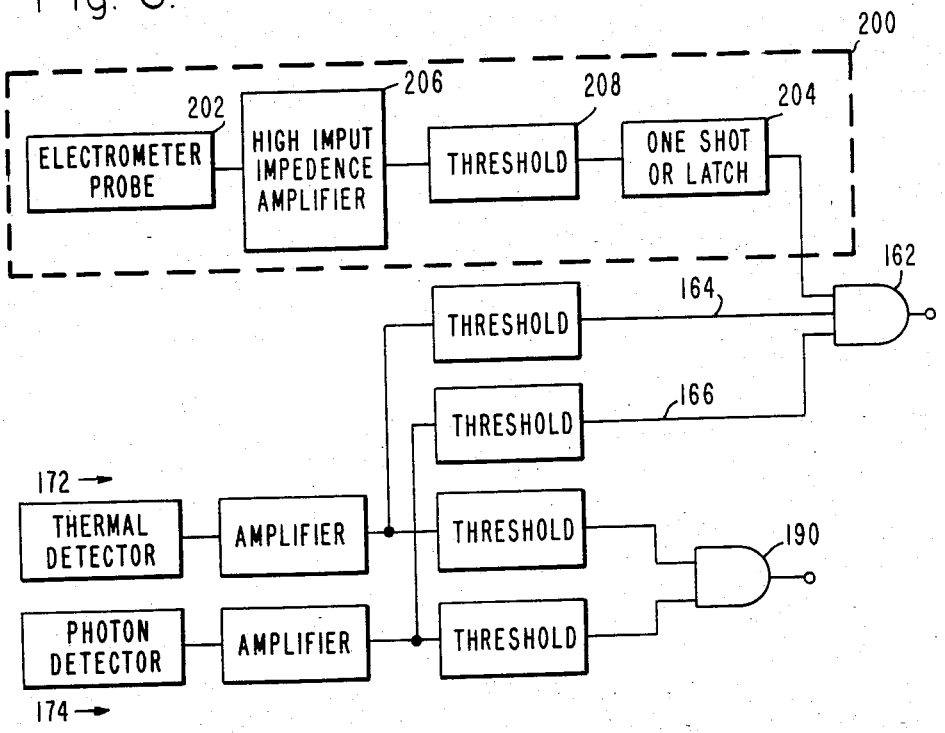
FIG. 6 is a functional block diagram of yet another embodiment of the invention including a three-channel (thermal/photon/electric field) fire sensing and suppression system.

Referring now to FIG. 6, it is seen that in this embodiment, the magnetic field sense channel of FIG. 5 has been replaced with an electric field sense channel which is designated generally as 200. This channel 200 includes an input electrometer probe 202 which responds to changes in static charge and electric field strength at the location of the probe 202. Once the static charge build-up at the location of the probe 202 reaches a predetermined threshold level sufficient to possibly ignite an explosion, this condition is stored in the channel 202 by operation of an output or one shot latch stage 204 which is connected as shown to the output AND gate 162. The small output signal from the electrometer probe 202 is amplified through a suitable high input impedance amplifier 206 and coupled through a threshold gate 208 to the one shot or latch circuit 204. This latch circuit 204 may, for example, be a one shot multivibrator or a flip flop.

Figure 8:
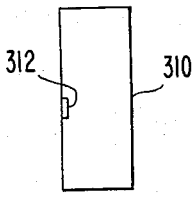
FIG. 8 is a schematic diagram showing a sensor mounted in a grain elevator.

A useful application of this embodiment of the invention is in a grain elevator 310 (FIG. 8) where dust in the air has been known to build up static charge on the order of ten thousand volts or more and thus create a potentially hazardous fire-producing environment. In this situation, the electrometer probe will pick up the static voltage build-up between the probe 312 and the dust to ground and couple this voltage through the high input impedance amplifier 206 where it is converted to a small signal output current and then processed to drive the threshold gate 208 which is biased to some predetermined reference voltage. Once the output signal to the threshold gate 208 exceeds this reference voltage, the output signal from the gate 208 triggers the latch stage 204. When this change occurs, the AND gate 162 is operative to enable channels 172 and 174 to respond to radiation from a fire or explosion in the elevator.

When a fire or explosion subsequently occurs, the optical radiation channels 172 and 174 respond to generate output signals on conductors 164 and 166 to the output AND gate 162. However, should a fire or explosion occur without sufficient electric charge being built up to activate the electric field channel 200, then the optical channels 172 and 174 will nevertheless generate an additional output fire suppression signal at the output AND gate 190 in the manner described in U.S. Pat. No. 3,931,521. As with the previously described embodiment in FIG. 5, the selectivity of the circuitry shown in FIG. 6, including the three input AND gate 162, is considerably greater than the selectivity associated with only a two input AND gate, particularly since the electric field channel 200 therein is normally energized only when static charge build-up has reached the point where a dust explosion is possible.

Various other system and circuit modifications may be made to the above described embodiments of our invention without departing from the scope of the appended claims. For example, the mechanical wave producing event accompanying the fire or explosion could be the physical shock which occurs when a shell impacts on a combat vehicle, aircraft or the like. For this situation, one could replace the pressure transducer 128 in FIG. 3 with an accelerometer which will generate an output electrical signal in response to an instantaneous change in accelleration produced by the mechanical shock experienced by the target. This change in acceleration can be as high as 1,000 Gs for a shell striking a combat vehicle.

Accordingly, one must examine the likelihood of the occurrence of a particular mechanical event either accompanying or likely to produce a fire or explosion and then choose a preferred mechanical wave transducer which will either be most responsive to the energy from this anticipated mechanical event, or the least likely to produce a false alarm from same, or a combination of both.

What is claimed is:

1. A method for sensing explosive fires which includes:

(a) sensing the substantially simultaneous occurrence of electromagnetic wave energy and mechanical wave energy emanating from said fire or explosion within a preselected time frame to in turn generate first and second detection signals, said mechanical wave energy being generated by an event likely to initiate a fire or explosion and preceding the generation of the electromagnetic wave energy; and (b) simultaneously processing said first and second detection signals in parallel to generate a fire suppression output signal; and (c) activating a fire suppressant in response to said output signal.

2. The method of claim 1 wherein the sensing of mechanical wave energy includes:

(a) sensing said mechanical wave energy with a sensor selected from the group of sensors consisting of acoustic sensors, mechanical vibrational sensors, accelerometers, magnetic field sensors and electric field sensors; and (b) positioning said mechanical wave energy sensor in an area to be protected from fires or explosions.

3. The method of claim 1 wherein the electromagnetic wave energy sensed in either optical or infrared radiation.

4. The method of claim 3 wherein the optical or infrared radiation is sensed in two parallel connected channels.

5. A system for sensing explosive fires which includes:

(a) means for sensing the substantially simultaneous occurrence of electromagnetic wave energy and mechanical wave energy emanating from a fire or explosion within a preselected time frame to in turn generate first and second detection signals, said mechanical wave energy being generated by an event likely to initiate a fire or explosion and preceding the generation of the electromagnetic wave energy;

(b) means connected to said sensing means for simultaneously processing said first and second detection signals electrically in parallel and at high speeds on the order of milliseconds to generate a first suppression output signal, said means including a circuit for stretching the second detection signal associated with mechanical wave energy to permit the generation of the fire suppression signal when the second signal precedes the generation of the first signal associated with the electromagnetic wave energy by a given time period; and (c) means for connecting said output signal to a fire suppressant for activating the fire suppressant in response to the generation of said output signal.

6. The system of claim 5 wherein said means for sensing mechanical wave energy includes a transducer selected from the group consisting of acoustic sensors, mechanical vibrational sensors, accelerometers, magnetic field sensors and electric field sensors.

7. The system of claim 5 which includes means for sensing electromagnetic wave energy in either the optical or infrared radiation bands of the electromagnetic wavelength spectrum.

8. The system of claim 7 which includes means for sensing either optical or infrared radiation, each in dual parallel connected signal processing channels.

9. The system according to claim 5 wherein said sensing means includes a microphone in one signal processing channel and a thermal detector in another parallel signal processing channel.

10. The system according to claim 5 wherein said sensing means includes a pressure transducer in one signal processing channel and an infrared or thermal detector in another parallel signal processing channel.

11. The system according to claim 5 wherein said sensing means includes a magnetic field transducer in one signal processing channel and thermal and photon detectors in parallel signal processing channels.

12. The system according to claim 5 wherein said sensing means includes an electric field transducer in one signal processing channel and thermal and photon detectors in parallel signal processing channels.

13. The system according to claim 5 wherein said sensing means includes either an optical or infrared radiation sensor in one signal processing channel and a mechanical wave energy transducer connected in a parallel-connected signal processing channel.

14. The system according to any one of claims 5–13 above wherein the fire suppression output signal is connected to drive a high speed valve for releasing a chosen fire suppressant such as halon gas or the like within a period of time on the order of milliseconds after the onset of a fire or explosion.

15. A system for detecting explosive fires, said system comprising:

(a) mechanical wave detector means for detecting the occurrence of mechanical wave energy associated with a fire or explosion, operative to generate a first output signal in response to mechanical wave energy above a given threshold level;

(b) first electromagnetic sensor means for sensing the occurrence of electromagnetic energy having a given wavelength that is associated with a fire or explosion;

(c) second electromagnetic sensor means for sensing the occurrence of electromagnetic energy having a second wavelength associated with a fire or explosion;

(d) first and second threshold means for defining given threshold levels for the first and second electromagnetic sensor means, respectively; operative to generate second and third output signals in response to detection of electromagnetic wave energy above said given threshold levels by the first and second electromagnetic sensors, respectively;

(e) first gating means for activating a fire suppressant in response to the substantially simultaneous occurrence of the first, second and third output signals;

(f) third and fourth threshold means also coupled to the first and second electromagnetic sensors and defining respectively higher threshold levels therefor than the threshold levels set by the first and second threshold means, with the third and fourth threshold means providing fourth and fifth output signals when the electromagnetic energy sensed by the first and second sensors are respectively above said higher threshold levels; and (g) second gating means for activating said fire suppressant independently of said first gating means in response to the substantially simultaneous occurrence of the fourth and fifth output signals.

16. The system of claim 15 wherein said mechanical wave detector means includes a mechanical wave sensor mounted on the housing of a fuel tank of a military vehicle.

17. The system of claim 15 wherein said mechanical wave detection means includes a magnetic field sensor having a transformer operative to generate an output signal in response to a change in the magnetic field surrounding the transformer.

18. The system of claim 17 wherein said transformer is located in sufficient proximity to detect the diversion of a moving metal part from a desired path of travel.

19. The system of claim 15 wherein said mechanical wave detection means includes an electric field sensor for sensing static electrical charge.

20. The system of claim 19 wherein said electric field sensor is mounted in a grain elevator and adapted to detect the static electrical charge therein.

* * * * *